US006658868B2

(12) United States Patent
Raab et al.

(10) Patent No.: US 6,658,868 B2
(45) Date of Patent: Dec. 9, 2003

(54) OPERATOR CONTROL PANEL FOR AN ELECTRICAL APPLIANCE

(75) Inventors: Alfred Raab, Hüttlingen (DE); Claudia Rupp, Neresheim (DE); Manfred Strobel, Langenau (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/356,107

(22) Filed: Jan. 31, 2003

(65) Prior Publication Data

US 2003/0115891 A1 Jun. 26, 2003

Related U.S. Application Data

(63) Continuation of application No. PCT/EP01/08681, filed on Jul. 26, 2001.

(30) Foreign Application Priority Data

Jul. 31, 2000 (DE) ..... 100 37 250

(51) Int. Cl.[7] ..... F25B 49/00
(52) U.S. Cl. ..... 62/126; 236/94
(58) Field of Search ..... 62/125, 126, 127, 62/131; 236/94; 248/542; 361/645, 725, 727; 200/293, 296, 308

(56) References Cited

U.S. PATENT DOCUMENTS

| | | | | |
|---|---|---|---|---|
| 4,404,813 A | * | 9/1983 | Paddock et al. | 62/127 |
| 4,936,106 A | * | 6/1990 | Beach, Jr. et al. | 62/131 |
| 4,966,004 A | * | 10/1990 | Midlang et al. | 62/77 |
| 5,366,185 A | | 11/1994 | Michael et al. | |
| 6,098,411 A | * | 8/2000 | Jeon | 62/125 |
| 6,169,256 B1 | * | 1/2001 | Hanahara et al. | 200/5 A |

FOREIGN PATENT DOCUMENTS

| | | |
|---|---|---|
| DE | 295 13 201 U1 | 1/1997 |
| FR | 2 641 908 A1 | 7/1990 |
| WO | WO 98/21727 | 5/1998 |

* cited by examiner

*Primary Examiner*—Marc Norman
(74) *Attorney, Agent, or Firm*—Laurence A. Greenberg; Werner H. Stemer; Ralph E. Locher

(57) ABSTRACT

An operator control panel for an electrical appliance, in particular, a refrigerator, includes a base panel for fastening on the electrical appliance, a control circuit for the electrical appliance, an insert for attachment to a visible side of the base panel, and an adapter for fastening the control circuit behind the base panel in a number of different positions.

22 Claims, 3 Drawing Sheets

OPERATOR CONTROL PANEL FOR AN ELECTRICAL APPLIANCE

CROSS-REFERENCE TO RELATED APPLICATION

This application is a continuation of copending International Application No. PCT/EP01/08681, filed Jul. 26, 2001, which designated the United States and was not published in English.

BACKGROUND OF THE INVENTION

FIELD OF THE INVENTION

The present invention relates to an operator control panel for an electrical appliance, in particular, a refrigerator.

Modern refrigerators, in particular, those configured for use as a stand-alone unit and not, for instance, for fitting into kitchen furniture, generally have a cuboidal housing, the front of which is mainly filled by a door. A narrow strip above the door is taken up by an operator control panel, on which a number of switches, controllers, and/or indicating elements for setting and indicating operating temperatures, proper operation or malfunctions, etc. are disposed, the number differing according to the model of refrigerator. The outer configuration of such refrigerators is determined within quite close limits by the intended use and leaves the manufacturers with little freedom of design for them to make their products stand but in their appearance from those of other manufacturers or else to differentiate from one another product lines that are produced by the same manufacturer but are marketed under different designations. The most important possibility for such differentiation is the configuration of the operator control panel, which often also bears the name of the manufacturer or the designation of the product line concerned as a brand. The manufacturer may, for example, place the operator control and indicating elements in the region on the left of the panel in the case of a first product line, in the region on the right in the case of a second product line and, possibly, centrally on the operator control panel in the case of a third product line, to bring about a certain stylistic distinguishability of the product lines.

It is customary to dispose behind the panel a unit including control electronics that generates the signals to be indicated on the panel and controls the operation of the refrigerator based upon the settings made by a user at controllers on the operator control panel. Because the same electronics units can be used in each case for appliances of different product lines with the same performance features in each case, costs can be saved in the production and later maintenance of the appliances. However, the different way in which the operator control elements are provided according to the product line makes it necessary for these electronics units to be installed at different locations behind the operator control panel, for example, to the right, to the left, or centrally, according to the product line. The operator control panels must, therefore, be produced in each case specifically for each individual appliance model. This leads to a considerable expenditure in the manufacture of respectively model-specific molds for the production of the panels and also in the stocking of spare parts.

SUMMARY OF THE INVENTION

It is accordingly an object of the invention to provide an operator control panel for an electrical appliance, in particular, a refrigerator, that overcomes the hereinaforementioned disadvantages of the heretofore-known devices of this general type and that can be used flexibly for a large number of appliance models with different configurations of the operator control and indicating elements on the operator control panel.

With the foregoing and other objects in view, there is provided, in accordance with the invention, an operator control panel, including a base panel to be fastened on an electrical appliance, the base panel having a visible side and a rear side, a control circuit for controlling the electrical appliance, an insert attached to the visible side of the base panel, and an adapter fastening the control circuit to a number of positions at the rear side of the base panel.

Based upon an operator control panel that has, in a conventional way, a base panel for fastening on an electrical appliance, in particular, a refrigerator, a control circuit for the electrical appliance and an insert for attachment to a visible side of the base panel, an adapter for fastening the control circuit behind the base panel is mounted on the base panel in a number of positions. These positions respectively correspond to the preferred installation positions of the operator control elements according to the product line. The base panel can, then, be the same for all product lines, an adaptation of the outer design to the configuration of the operator control elements merely being required in the case of the insert. Because, however, the insert is only a flat strip with several cutouts or windows matching the position of indicating and/or operator control elements and, possibly, a printed-on inscription, the unavoidable model-specific production here entails minimal expenditure.

In accordance with the elongate form of the operator control panel, the various positions at which the adapter can be mounted are respectively offset from one another in the longitudinal direction of the panel; at the same time, partial overlapping of the positions is not ruled out. The adapter, preferably, has a set of fastening elements, and a number of sets of fastening elements that are identical to one another and complementary to the adapter are respectively disposed at the different installation positions of the base panel. The fastening elements removably fasten the adapter to the base panel.

The adapter may be an independent component; however, it may also be combined with the control circuit to form a structural unit.

An important function of the adapter is to form a holder for indicating elements and/or controllers and/or operating buttons for control. The adapter can removably hold the element(s).

In particular, in the case of refrigerators that respectively have cooling or refrigerating zones of different temperatures, it is conceivable for a number of control circuits to be disposed behind the operator control panel, it being possible, for example, for each of these control circuits to serve for controlling one of the cooling zones. In such a case, just as in the case of a single electronics unit, a flexible design of the operator control panel is possible if the adapters of the number of control circuits can be mounted on the base panel in a number of configurations.

In accordance with another feature of the invention, there is provided at least one second control circuit and a second adapter fastening the at least one second control circuit to a number of positions at the rear side of the base panel; the adapter and the second adapter simultaneously mounted on the base panel in a number of adapter configurations.

With the objects of the invention in view, there is also provided a refrigerator, including a housing and an operator control panel connected to the housing, the control panel having a base panel removably fastened to the housing, the base panel having a visible side and a rear side, a control circuit for controlling the refrigerator, an insert attached to the visible side of the base panel, and an adapter fastening the control circuit to a number of positions at the rear side of the base panel.

With the objects of the invention in view, in combination with a refrigerator, there is also provided an operator control panel, including a base panel to be fastened to the refrigerator, the base panel having a visible side and a rear side, a control circuit for controlling the refrigerator, an insert attached to the visible side of the base panel, and an adapter fastening the control circuit to a number of positions at the rear side of the base panel.

Other features that are considered as characteristic for the invention are set forth in the appended claims.

Although the invention is illustrated and described herein as embodied in an operator control panel for an electrical appliance, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
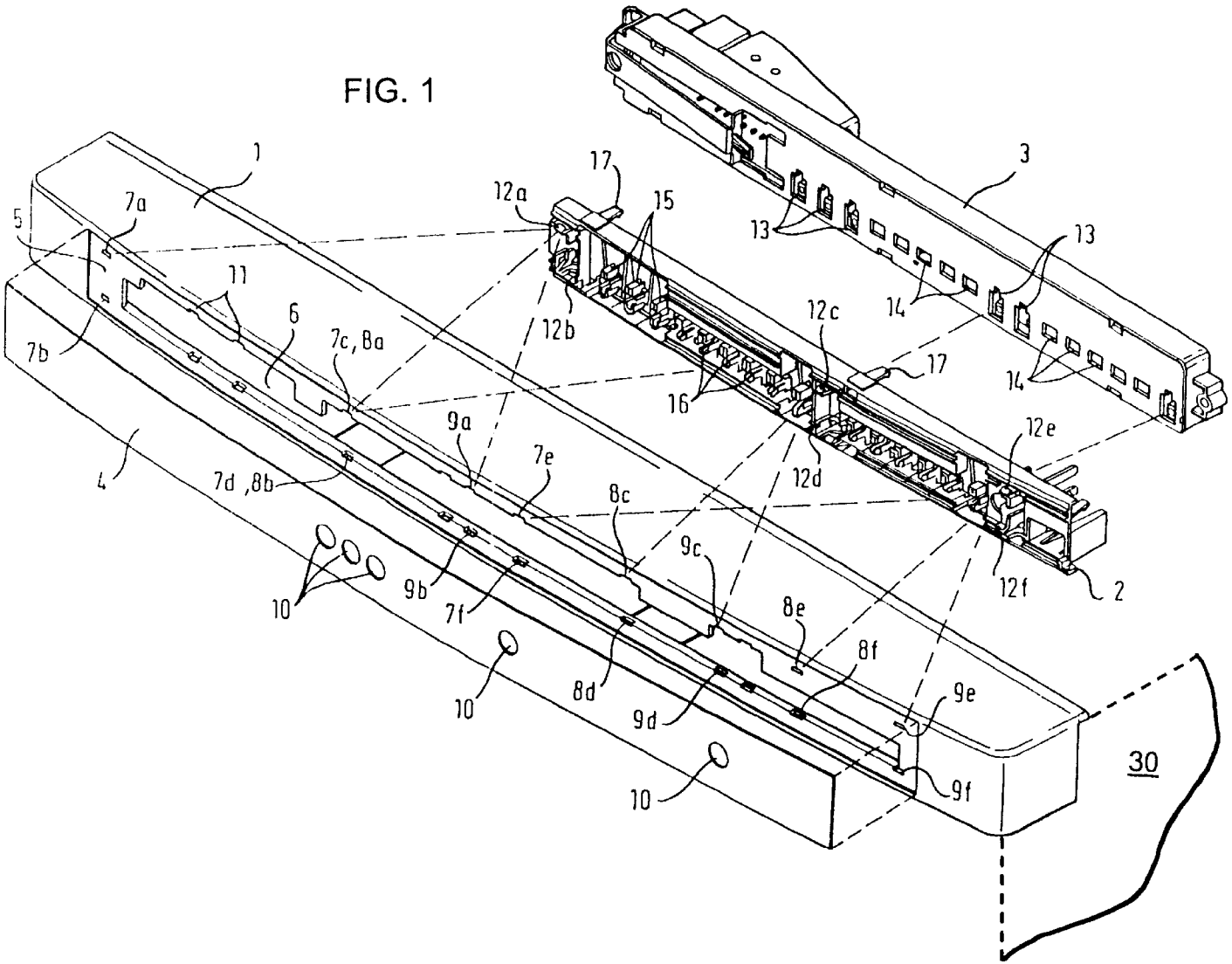
FIG. 1 is an exploded perspective view of an exemplary construction of an operator control panel according to the invention.

Referring now to the figures of the drawings in detail and first, particularly to FIG. 1 thereof, there is shown the construction of the panel according to the invention in an exploded representation. It is made up of a base panel 1, which is provided for fastening on the housing 30 of a refrigerator, an adapter 2, an electronics unit 3, which undertakes control functions of the refrigerator, and an insert 4.

The base panel 1 is an elongate hollow body of plastic, which is manufactured, for example, by injection-molding. On a visible side facing a user of the refrigerator, it has a depression 5, which is dimensioned such that it receives the insert 4 with a form fit so that a flush and closed front portion of the panel is formed. A form-locking connection is one that connects two elements together due to the shape of the elements themselves, as opposed to a force-locking connection, which locks the elements together by force external to the elements. Formed in the depression 5 is an elongate cutout 6, which extends over the greater part of the rear side of the insert 4 and through which connecting elements between buttons, rotary switches, or the like disposed at openings 10 of the insert extend through the adapter 2 to corresponding switching elements of the electronics unit 3 when the operator control panel is completely fitted. The cutout 6 also forms a window through which illuminated indicating elements, such as, for instance, individual light-emitting diodes, seven-segment displays for digital representation, etc., can be seen through a transparent or translucent window of the insert 4 for a user standing in front of the refrigerator.

For fastening the adapter 2 on the base panel 1, the base panel 1 has a multiplicity of snap-in notches 7*a*, 7*b* . . . , 7*f*, 8*a*, . . . , 8*f*, 9*a* . . . , 9*f*, most of which are disposed on the edge of the cutout 6. The snap-in notches form three sets 7*a*, 7*b*, . . . , 7*f*; 8*a*, . . . , 8*f* and 9*a*, . . . , 9*f*, each snap-in notch of a set being disposed such that it can respectively receive one of six snap-in hooks 12*a*, 12*b*, . . . , 12*f* of the adapter 2. The three sets of snap-in notches respectively correspond to an installation position of the adapter 2 on the left, at the center, and on the right. Individual snap-in notches, such as, for instance, those designated perhaps by 7*c* and 8*a* or 7*d*, 8*b*, belong to a number of sets, because they can receive the two snap-in hooks 12*c*, 12*d* in the installation position of the adapter on the left and the snap-in hooks 12*a*, 12*b* in the central installation position.

The electronics unit 3 is accommodated in a plastic housing, which has a number of openings 13, 14, behind which switching elements or light-emitting diodes are respectively-disposed on a non-illustrated printed circuit board of the electronics unit 3. The adapter 2 has, in a configuration complementary to the configuration of the openings 13, 14, a number of holders 15, 16, the holders 15 respectively serving for the displaceable reception of a non-illustrated pin, one end of which extends through one of the openings 10 of the insert 4 and forms a button and the other end acts on the switching element behind the opening 13. The holders 16 serve for the fixed reception of non-illustrated light guides that conduct light emitted by light-emitting diodes disposed behind the openings 14 to the rear side of the insert 4.

The holders 15, 16 and the pins and light guides to be introduced into them are respectively formed such that the pins or light guides can be introduced from the rear side of the adapter, facing the electronics unit 3, into the holders as far as a stop and, as a result, are secured against falling out after the adapter 2 and electronics unit 3 have been joined together.

Disposed on the rear side of the adapter 2 respectively along the upper and lower edges of the adapter and lying opposite one another are snap-in hooks 17, which serve for fastening the adapter 2 on the electronics unit 3 by clipping one onto the other.

Because the adapter 2 is formed as a part that is separate from the base panel 1, both the adapter 2 and the base panel 1 can be produced in a simple and inexpensive way by slideless open-close molds.

In the case of a variant of a non-illustrated operator control panel, the adapter is formed integrally with plastic parts of the housing of the electronics unit. As such, one working step in the assembly of the operator control panel is saved. In the case of such an integral design, connecting parts such as the aforementioned pins and light guides are introduced into their respective holders from the front side of the adapter and snap-fitted therein.

To make the panel according to the invention usable for different models of refrigerators, it is sufficient if, for example, in the case of a more simple model with a reduced range of functions, a switching element or a light-emitting diode is not disposed behind all the openings 13, 14 of the electronics unit. The housing of the electronics unit 3 and the adapter 2 can, consequently, also be used unchanged for a more simple appliance model; only the insert 4 has to be adapted, for example, by reducing the number of openings 10 and adapting a printed-on inscription.

Figure 2:
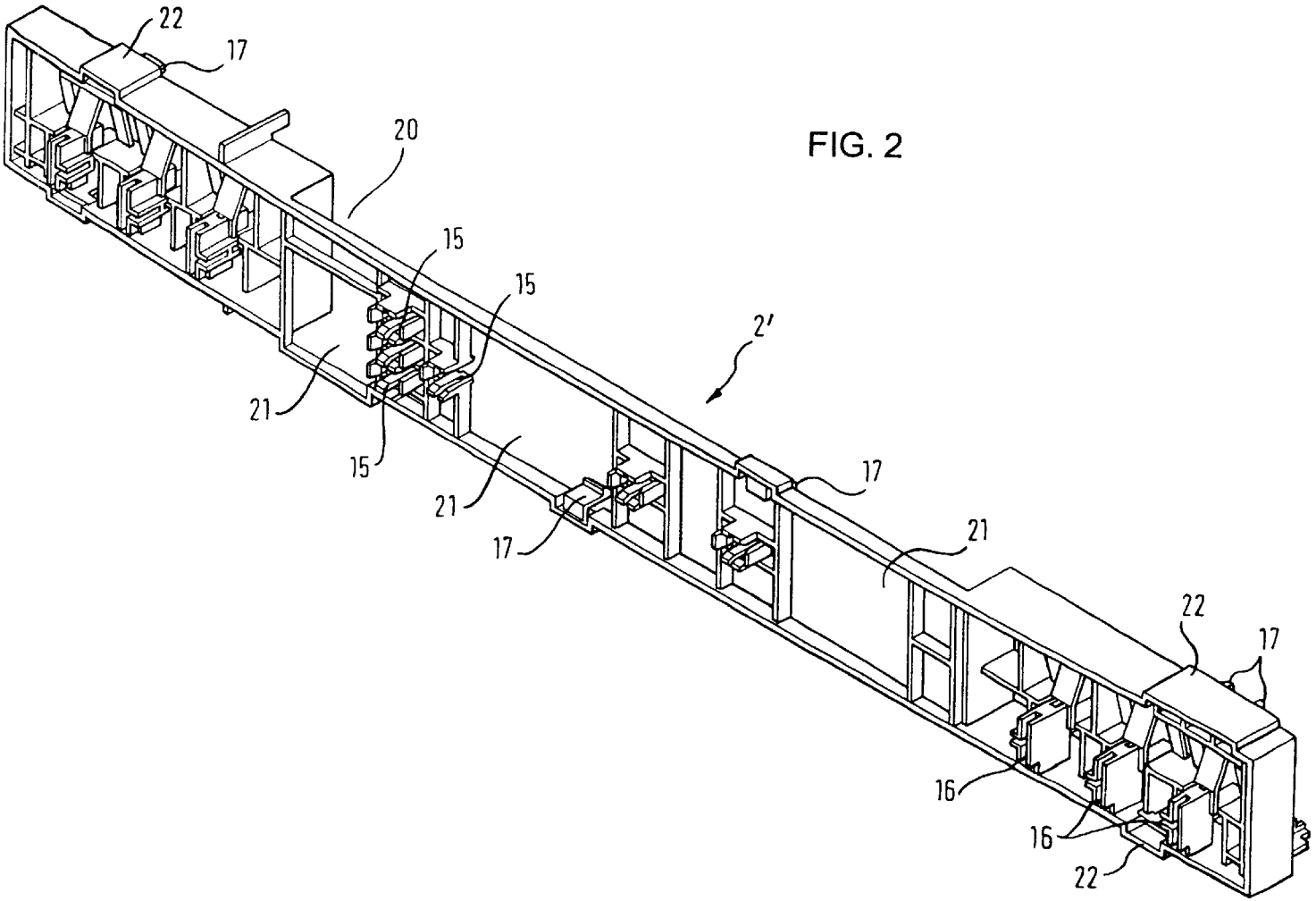
FIG. 2 is a perspective view of an alternative embodiment of an adapter for an operator control panel according to the invention.
Figure 3A:
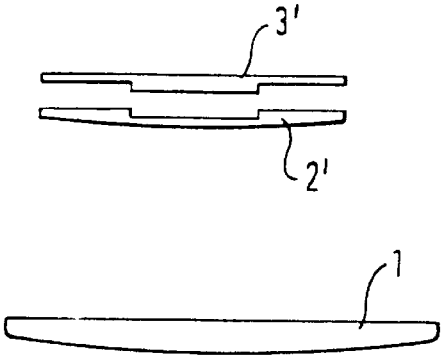
FIG. 3A is a diagrammatic plan view of a panel concept according to the invention for the construction of operator control panels for various models of refrigerators.
Figure 3B:
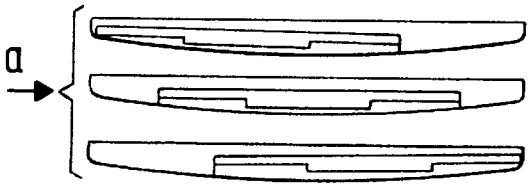
FIG. 3B is a diagrammatic plan view of three possible configurations of the panel concept of FIG. 3A.

It goes without saying that the panel can also be made usable for refrigerators with an increased range of functions by using a different type of electronics unit 3 and an adapted adapter. For example, an adapter 2' of the type shown in FIG. 2 may be used, the rear side of which, facing the electronics unit (not shown in FIG. 2), has an elongate clearance 20, into which seven-segment displays fitted on the housing of the electronics unit can engage. Openings 21 of a large area provide a view from the front of the seven-segment displays. Also present on the adapter 2' are holders 15, 16 for buttons and/or light guides and also snap-in hooks 17 for fastening on the electronics unit.

For the fastening on the base panel 1, the adapter 2' has a number of butt straps 22, which respectively overhang upward or downward from the upper side or underside of the adapter 2' and respectively receive a projecting snap-in lug of the base panel. The overhanging configuration of the snap-in butt straps 22 achieves the effect that snap-in lugs that correspond to other, partially overlapping positions of the adapter 2' on the base panel 1 respectively lie above and below the adapter 2', and, thus, do not hinder the assembly of the operator control panel.

FIGS. 3A, 3B, 4A, 4B, 4C, and 5 illustrate the great variety of appliance models that can be equipped with individual operator control panels with the aid of the present invention using a small number of parts.

Figure 4A:
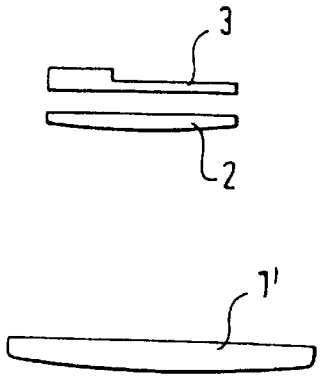
FIG. 4A is a diagrammatic plan view of an alternative panel concept smaller than the concept of FIG. 3A according to the invention for the construction of operator control panels for various models of refrigerators.
Figure 4B:
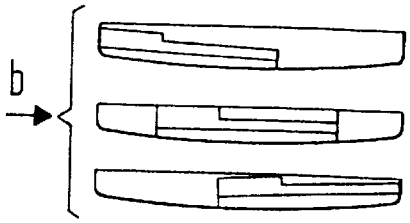
FIG. 4B is a diagrammatic plan view of three possible configurations of the panel concept of FIG. 4A.
Figure 4C:
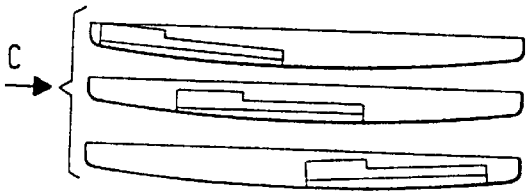
FIG. 4C is a diagrammatic plan view of three possible configurations of the panel of FIG. 3A combined with the adapter and electronics unit of FIG. 4A.

If, for example, just the two different types of adapter 2, 2' described above and the associated electronics units 3, 3', and base panels 1, 1' with two different widths for two different overall sizes of appliances are considered (see FIGS. 3A and 4A), this, already, provides three model groups a, b, c, each with three models differing according to the installation position of the adapter and the electronics unit. See FIGS. 3B and 4B. The smaller adapter 2 and unit 3 combination can be placed in the larger panel 1 as shown in FIG. 4C. Also, if the base panel 1' is wide enough also to receive the wider of the two electronics units 3' in different positions, a fourth model group can be provided.

Figure 5:
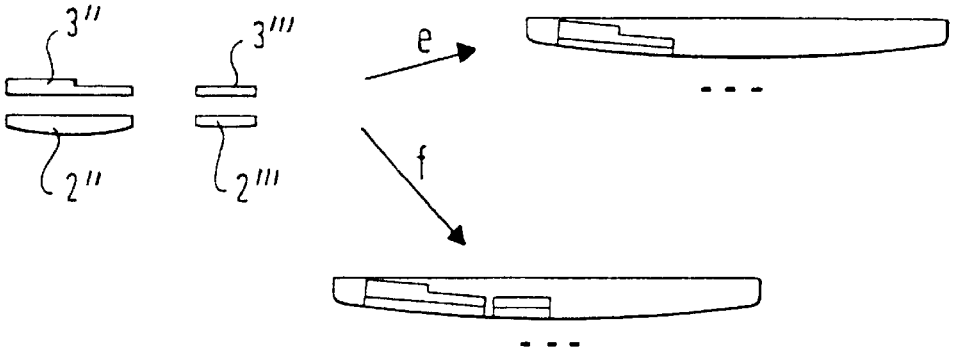
FIG. 5 is a diagrammatic plan view of an third panel concept according to the invention for the construction of operator control panels for various models of refrigerators with expansion modules.

If, in addition, the possibility of a modular construction of the electronics unit and its adapter is taken into consideration, for example, to the extent that a basic circuit 3" that has all the control and indicating functions of a simple appliance model is used, and to which expansion modules 3'" for further functions are added according to requirements, the variety of models can be increased even more, FIG. 5 depicting only one example in each case from the resultant model groups e, f. In such a case, modularization can be performed, for example, to the extent that the basic circuit 3" is configured for indicating and control functions of a basic standard refrigerator, and that an additional module 3'" is used in the case of the combined refrigerator for indicating the temperature or for controlling a freezing or chilling compartment. It would also be conceivable to modularize the indicating functions, to the extent that a basic circuit 3", which undertakes the control functions, is combined with in each case different additional modules 3'" used for indicating the operating state of the appliance with the aid of simple light-emitting diodes or for indicating a quantitative temperature value by a seven-segment display.

We claim:

1. An operator control panel, comprising:

a base panel to be fastened on an electrical appliance, said base panel having a visible side and a rear side;

a control circuit for controlling the electrical appliance;

an insert attached to said visible side of said base panel; and an adapter fastening said control circuit to a number of positions at said rear side of said base panel.

2. The operator control panel according to claim 1, wherein:

said base panel has a longitudinal direction; and said positions are respectively offset from one another in said longitudinal direction.

3. The operator control panel according to claim 1, wherein:

said base panel has a number of identical sets of fastening elements offset from one another; and said fastening elements removably fasten said adapter to said base panel.

4. The operator control panel according to claim 1, wherein said adapter is connected to said control circuit to form a structural unit.

5. The operator control panel according to claim 1, including at least one element for said control circuit selected from a group consisting of indicating elements, controllers, and operating buttons, said adapter holding said at least one element.

6. The operator control panel according to claim 1, wherein said adapter removably holds said at least one element.

7. The operator control panel according to claim 1, including at least one second control circuit and a second adapter fastening said at least one second control circuit to a number of positions at said rear side of said base panel; said adapter and said second adapter simultaneously mounted on said base panel in a number of adapter configurations.

8. The operator control panel according to claim 1, wherein the electrical appliance is a refrigerator.

9. A refrigerator, comprising:

a housing; and an operator control panel connected to said housing, said control panel having:

a base panel removably fastened to said housing, said base panel having a visible side and a rear side;

a control circuit for controlling the refrigerator;

an insert attached to said visible side of said base panel; and an adapter fastening said control circuit to a number of positions at said rear side of said base panel.

10. The operator control panel according to claim 9, wherein:

said base panel has a longitudinal direction; and said positions are respectively offset from one another in said longitudinal direction.

11. The operator control panel according to claim 9, wherein:

said base panel has a number of identical sets of fastening elements offset from one another; and said fastening elements removably fasten said adapter to said base panel.

12. The operator control panel according to claim 9, wherein said adapter is connected to said control circuit to form a structural unit.

13. The operator control panel according to claim 9, including at least one element for said control circuit selected from a group consisting of indicating elements, controllers, and operating buttons, said adapter holding said at least one element.

14. The operator control panel according to claim 13, wherein said adapter removably holds said at least one element.

15. The operator control panel according to claim 9, including at least one second control circuit and a second adapter fastening said at least one second control circuit to a number of positions at said rear side of said base panel; said adapter and said second adapter simultaneously mounted on said base panel in a number of adapter configurations.

16. In combination with a refrigerator, an operator control panel, comprising:

a base panel to be fastened to the refrigerator, said base panel having a visible side and a rear side;

a control circuit for controlling the refrigerator;

an insert attached to said visible side of said base panel; and an adapter fastening said control circuit to a number of positions at said rear side of said base panel.

17. The operator control panel according to claim 16, wherein:

said base panel has a longitudinal direction; and said positions are respectively offset from one another in said longitudinal direction.

18. The operator control panel according to claim 16, wherein:

said base panel has a number of identical sets of fastening elements offset from one another; and said fastening elements removably fasten said adapter to said base panel.

19. The operator control panel according to claim 16, wherein said adapter is connected to said control circuit to form a structural unit.

20. The operator control panel according to claim 16, including at least one element for said control circuit selected from a group consisting of indicating elements, controllers, and operating buttons, said adapter holding said at least one element.

21. The operator control panel according to claim 20, wherein said adapter removably holds said at least one element.

22. The operator control panel according to claim 16, including at least one second control circuit and a second adapter fastening said at least one second control circuit to a number of positions at said rear side of said base panel; said adapter and said second adapter simultaneously mounted on said base panel in a number of adapter configurations.

* * * * *